US009967921B2

(12) United States Patent
Bolger

(10) Patent No.: US 9,967,921 B2
(45) Date of Patent: May 8, 2018

(54) HEATING BODY

(75) Inventor: Michael J. Bolger, Exeter, NH (US)

(73) Assignee: Runtal Holding Company SA, Gränichen (CH)

( * ) Notice: Subject to any disclaimer, the term of this patent is extended or adjusted under 35 U.S.C. 154(b) by 592 days.

(21) Appl. No.: 12/975,653

(22) Filed: Dec. 22, 2010

(65) Prior Publication Data

US 2012/0160825 A1 Jun. 28, 2012

(51) Int. Cl.
*H05B 3/02* (2006.01)
*H05B 3/22* (2006.01)

(52) U.S. Cl.
CPC ..... *H05B 3/22* (2013.01)

(58) Field of Classification Search
CPC ..... H05B 3/22
USPC ..... 219/538, 202, 504–505, 540; 392/347, 392/360, 355, 485
See application file for complete search history.

(56) References Cited

U.S. PATENT DOCUMENTS 3,396,458 A * 8/1968 Meng et al. ..... 29/615
5,995,711 A * 11/1999 Fukuoka et al. ..... 392/347
2009/0214913 A1* 8/2009 Gschwind ..... 429/24

* cited by examiner

*Primary Examiner* — Shawntina Fuqua
(74) *Attorney, Agent, or Firm* — Gudrun E. Huckett

(57) ABSTRACT

In order to provide a heating body where the occurrence of excessive surface temperatures in certain spots or also in large areas is avoided, a heating body is suggested wherein the heat source and the body element are connected with each other by lamellae arranged between them.

6 Claims, 1 Drawing Sheet

Fig. 1
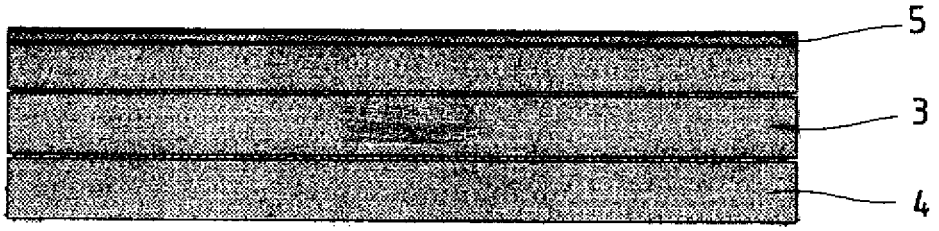
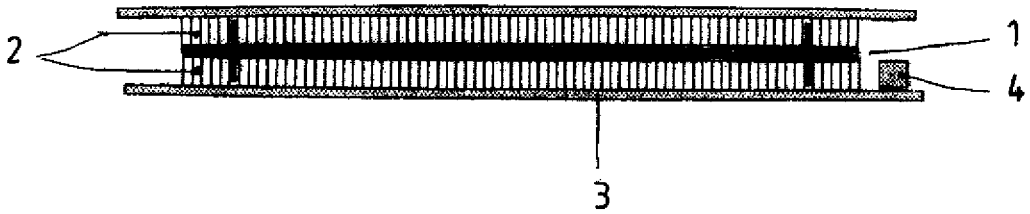
Fig. 2

HEATING BODY

BACKGROUND OF THE INVENTION

The present invention relates to a heating body.

Heating bodies usually comprise a body element through which a fluid flows, in particular flat body elements. These body elements can be hot plates, or also flat rectangular heating rods, tubes, and the like. A fluid circulating in this body element distributes the heat as evenly as possible over the entire surface.

It has also been known to design electric heating bodies in such a way that the fluid is heated by an electric heating rod; another known method is to heat corresponding surfaces through which a fluid flows with electric energy directly from outside.

The state of the art has shown that such heating bodies have one disadvantage, which is that excessive surface temperatures can occur in certain spots. This can even lead to slight burns, which is why this is prohibited in many states.

Starting from this state of the art, the main object underlying the present invention is to provide a heating body where the occurrence of excessive surface temperatures in certain spots or in large areas is avoided.

SUMMARY OF THE INVENTION

For the technical solution of this main object, a heating body is proposed that has a body element containing a heating medium and a heat source, wherein the heat source and the body element are connected with each other by lamellae arranged between them. Other advantages and features result from the dependent claims.

According to the invention, lamellae are arranged between the body element and the heat source. In this manner, the heat source initially heats the lamellae, and then the body element in the contact area, which is not accessible. Through this body element, all parts of the radiator are heated.

Due to this manner of indirect heating, the occurrence of excessive surface heat, either in certain spots or in large areas in the externally accessible areas, is prevented.

In a beneficial manner, an electric heat source is used, and in a particularly beneficial manner, a heating film is used.

The lamellae are essentially arranged all over the body element and, as far as this is technically reasonable and possible, they are also fully served by the heat source.

By means of a control, it can be ensured that a maximum temperature will not be exceeded in any part of the externally accessible surface of body element.

In a beneficial manner, the heating body can be designed as a double heating body, wherein lamellae, and then body elements, are arranged on both sides of the heating film.

The invention provides a simple solution which can be realised with little economic effort to operate a heating body, in particular an electric heating body, in such a way that predetermined maximum temperatures are not exceeded.

Moreover, the heating body according to the invention has the advantage that initially, it provides a very fast reaction, since air flows around the lamellae and these lamellae are the first to show an effect also as heat-dissipating lamellae.

BRIEF DESCRIPTION OF THE DRAWINGS

Other advantages and features of the invention can be gathered from the following description on the basis of the figures. In these figures:

FIG. 1 is a front view of an exemplary embodiment of a heating body according to the invention, and FIG. 2 is a top view onto the heating body according to FIG. 1

DESCRIPTION OF PREFERRED EMBODIMENTS

The exemplary embodiment shown is an electric heating film 1 positioned between two lamella packages 2. The lamella packages for their part are provided with front panels 3 on the respective other outer sides, whereby these lamella packages lead the heat to the front panel. Thermostat limits the maximum temperature of the heating film.

In the exemplary embodiment shown, heat is transferred from the electric heating film 1 to the metal lamellae 2 behind the front panel 3 of the heating body. The lamellae may be mechanically connected to the front elements, e. g. by welding. The heat generated by the heating film is evenly distributed via the lamellae to front panel 3 of the heating body, which front panel 3 is only moderately heated in this process. The surface of the radiator ensures that in relation of the maximum output of the heating film that predetermined maximum surface temperatures on the outside are not exceeded, so that persons touching the outside will not suffer burns, for instance.

Despite the overall low surface temperatures, the heating body has a high output, since in addition, also the multitude of directly heated lamellae which, however, are not accessible from outside, guarantee high convective heat dissipation due to their large surface.

The dimensioning with respect to the output of the heating film on the one hand and the dimensioning of the metallic surface on the other hand ensure that the predetermined maximum surface temperatures in any of the touchable parts of the heating body cannot be exceeded in any operating mode.

On the top, the heating body is provided with a grid cover 5, so that also the lamellae cannot be touched.

The described exemplary embodiment only serves a better understanding and is not restrictive

LIST OF REFERENCE NUMERALS

1 Heating film
2 Lamellae
3 Heating body front
4 Control
5 Grid cover

What is claimed is:

1. A radiator comprising body elements, the body elements each having an interior through which a fluid as a heating medium circulates, and further comprising a heat source, wherein the heat source and the body elements extend parallel to each other in parallel planes, the heat source located between the body elements, and are connected with each other by lamellae arranged between the heat source and the body elements, respectively, wherein the lamellae and the body elements are welded together, wherein the heat source initially heats the lamellae and then the lamellae heat the body elements, wherein the lamellae are positioned orthogonally relative to the parallel planes of the heat source and the body elements, wherein the heat source is an electric heating film and wherein the radiator comprises a high temperature control operatively connected to the electric heating film.

2. A radiator according to claim 1, wherein the heat source is formed as an area element.

3. A radiator according to claim 1, wherein the lamellae are essentially arranged all over the body element.

4. A radiator according to claim 1, wherein the lamellae are arranged on both sides of the heat source.

5. A radiator according to claim 1, wherein the surface of the radiator in relation to the maximum output of the electric heating film ensures a maximum surface temperature of 140 F.

6. A radiator according to claim 1, wherein the high temperature control is configured to prevent that any part of an externally accessible surface of the body elements exceeds a maximum temperature.

* * * * *